US006550071B2

(12) United States Patent
Garneau

(10) Patent No.: US 6,550,071 B2
(45) Date of Patent: Apr. 22, 2003

(54) CYCLIST HELMET WITH REINFORCING HOOPS

(75) Inventor: Louis Garneau, St-Augustin-de-Desmaures (CA)

(73) Assignee: Louis Garneau Sports Inc., St-Augustin-de-Desmaures (CA)

( * ) Notice: Subject to any disclaimer, the term of this patent is extended or adjusted under 35 U.S.C. 154(b) by 39 days.

(21) Appl. No.: 09/944,394

(22) Filed: Sep. 4, 2001

(65) Prior Publication Data

US 2003/0056279 A1 Mar. 27, 2003

(51) Int. Cl.[7] ..... A63B 71/10; A42B 3/00
(52) U.S. Cl. ..... 2/425; 2/411
(58) Field of Search ..... 2/410, 425, 411, 2/412

(56) References Cited

U.S. PATENT DOCUMENTS 5,088,130 A * 2/1992 Chiarella ..... 2/411
5,099,523 A * 3/1992 Broersma ..... 2/411
5,337,421 A 8/1994 Jeng
5,351,341 A * 10/1994 Broersma ..... 2/412
5,450,631 A 9/1995 Egger
5,481,762 A * 1/1996 Gentes et al. ..... 2/411
D372,559 S 8/1996 Murakami
D375,582 S 11/1996 Garneau
5,619,756 A 4/1997 Garneau
D388,551 S 12/1997 Lu
5,734,994 A 4/1998 Rogers
5,813,055 A 9/1998 Egger
5,833,796 A * 11/1998 Matich ..... 2/425
D411,337 S 6/1999 Schultz
D411,338 S 6/1999 Egger et al.
D426,677 S 6/2000 Ho

* cited by examiner

*Primary Examiner*—Rodney M. Lindsey
(74) *Attorney, Agent, or Firm*—Francois Martineau

(57) ABSTRACT

A bicycle helmet that allows ventilation to a cyclist head. The helmet comprises a hard internal shell, a hard external shell, and a shock absorbing foam insert located between the internal and external shells. The helmet consists of a generally open concave structure having a number of fore and aft extending structural arms, transversely spaced from one another and merging with an annular bottom edge rim at both their fore and aft ends. Each structural arm forms a U-shape in cross-section, for reinforcing the helmet structure. The shock absorbing foam of the insert engages with the grooves formed by these cross-sectionally U-shape structural arms. Air ventilation passages are formed in between each pair of successive U arms, extending through corresponding openings in the shock absorbing insert and through the open mouth formed by the annular internal shell. The radius of curvature of the structural arms is greater than that of the shock absorbing insert.

20 Claims, 13 Drawing Sheets

CYCLIST HELMET WITH REINFORCING HOOPS

OBJECT OF THE INVENTION

An object of the invention is to provide a stronger and more lightweight cyclist helmet, yet while maintaining optimum head protection capabilities.

SUMMARY OF THE INVENTION

In accordance with the object of the invention, there is disclosed a generally open concave bicycle helmet comprising a hard external shell, a shock absorbing insert located radially inwardly of said external shell; said external shell defining a number of fore and aft extending structural arms, each of said structural arms having a fore end and an aft end, said structural arms transversely spaced from one another in transversely successive pairs by transverse inter-spacing gaps, said structural arms merging with an annular edge rim at both said fore end and aft end thereof, said insert having radial passageways in register with said inter-spacing gaps, said inter-spacing gaps and said radial passageways forming air ventilation channels; each of said structural arms being arcuate in cross-section, said arcuate structural arms each forming two side walls circumscribing therebetween a corresponding groove, said insert defining an exposed surface, said structural arm side walls being embedded into selected portions of said insert exposed surface; wherein the radius of curvature of said structural arms is greater than that of said insert exposed surface.

Preferably, said structural arms consist of U-shape arms, said arms side wall being inturned against said insert. Said insert exposed surface could include a number of projecting ridges, said insert ridges engaging into each said groove of corresponding said structural arms, said insert ridges extending radially outwardly beyond said insert exposed surface.

The depth of said arms groove could range between 3 and 38 mm, preferably being about 7 mm; while the total width of each of said structural arms could range between 3 and 38 mm, again preferably being about 7 mm. Preferably, the material forming said structural U-arms is molded polycarbonate plastic material. Said structural U-arms could extend in a generally straight fashion in the fore and aft direction, or alternately in a sinusoidal fashion in the fore and aft direction. Alternately, each of said structural U-arms could converge from said aft end to said fore end thereof. Each one of said inter-spacing gaps could range between 3 and 38 mm.

The invention also relates to a bicycle helmet comprising a generally open concave shock absorbing insert, said insert defining a top exposed surface and an internal face in communication with one another via air circulation passageways extending radially through said insert, a number of rigid reinforcing cross-sectionally U-shape hoops extending across corresponding strip portions of said insert exposed surface, each of said U-shape hoops defining two opposite side legs and a groove between said side legs, said hoops side legs being embedded radially inwardly into corresponding said insert strip portions; wherein the radius of curvature of said hoops is greater than that of said insert exposed surface.

In this case, there may be added ridges, radially outwardly projecting from said insert exposed surface integral thereto, said ridges engaging substantially fully into each said groove of said U-shape hoops and also projecting radially outwardly beyond said insert exposes surface. The depth and total width of said ridges could each ranges between 3 and 38 mm, again being preferably about 7 mm. Said hoops could extend in a direction selected from the following: straight, sinusoidal and arcuate patterns.

The invention also relates to a bicycle helmet comprising a generally open concave shock absorbing insert, said insert defining a top exposed surface and an internal face in communication with one another via air circulation passageways extending radially through said insert, a number of rigid reinforcing cross-sectionally U-shape hoops extending across corresponding fore and aft extending strip portions of said insert exposed surface, each of said U-shape hoops defining two opposite side legs and a groove between said side legs, said hoops side legs being embedded into corresponding said insert strip portions; wherein the radius of curvature of said hoops is greater than that of said insert exposed surface.

FIELD OF THE INVENTION

This invention relates to protective headgear for use on roads by cyclists.

BACKGROUND OF THE INVENTION

Protective headgear helmets for use by bicyclists need to address a number of needs, some of which being difficult to reconcile with one another. The first need is of course to provide proper protection of the cyclist head from trauma injury following accidental impacting fall to the ground, notably when the bicycle rolls at high speed on the ground. In particular, the helmet should be so constructed as to be resistant to fragmentation after a first violent impact, as many high speed falls of cyclists involve multiple ground impact of the cyclist head. A helmet is of course of limited value if it is effective in protecting the cyclist head from impact trauma from a first ground impact, but becomes inoperative afterwards due to fracturing, fragmenting or the like impact borne deformation. Helmets also need to provide suitable shielding protection against headborne sun stroke, since it may not be readily apparent to the cyclist that a sun stroke is imminent because of the incoming wind that refreshes his/her face as his bicycle moves forward. Helmets should also preferably provide for proper air ventilation of the head, again to fight against sun strokes. On the other end, the weight of the helmet should be kept down as low as possible, so as not to generate fatigue to the neck of the cyclist, as this would be a safety hazard in compromising the attention span of the cyclist when his vehicle is on the road. Prior art helmets still do not provide for an optimum mix of these desirable parameters.

DETAILED DESCRIPTION OF THE EMBODIMENTS

Figure 1:
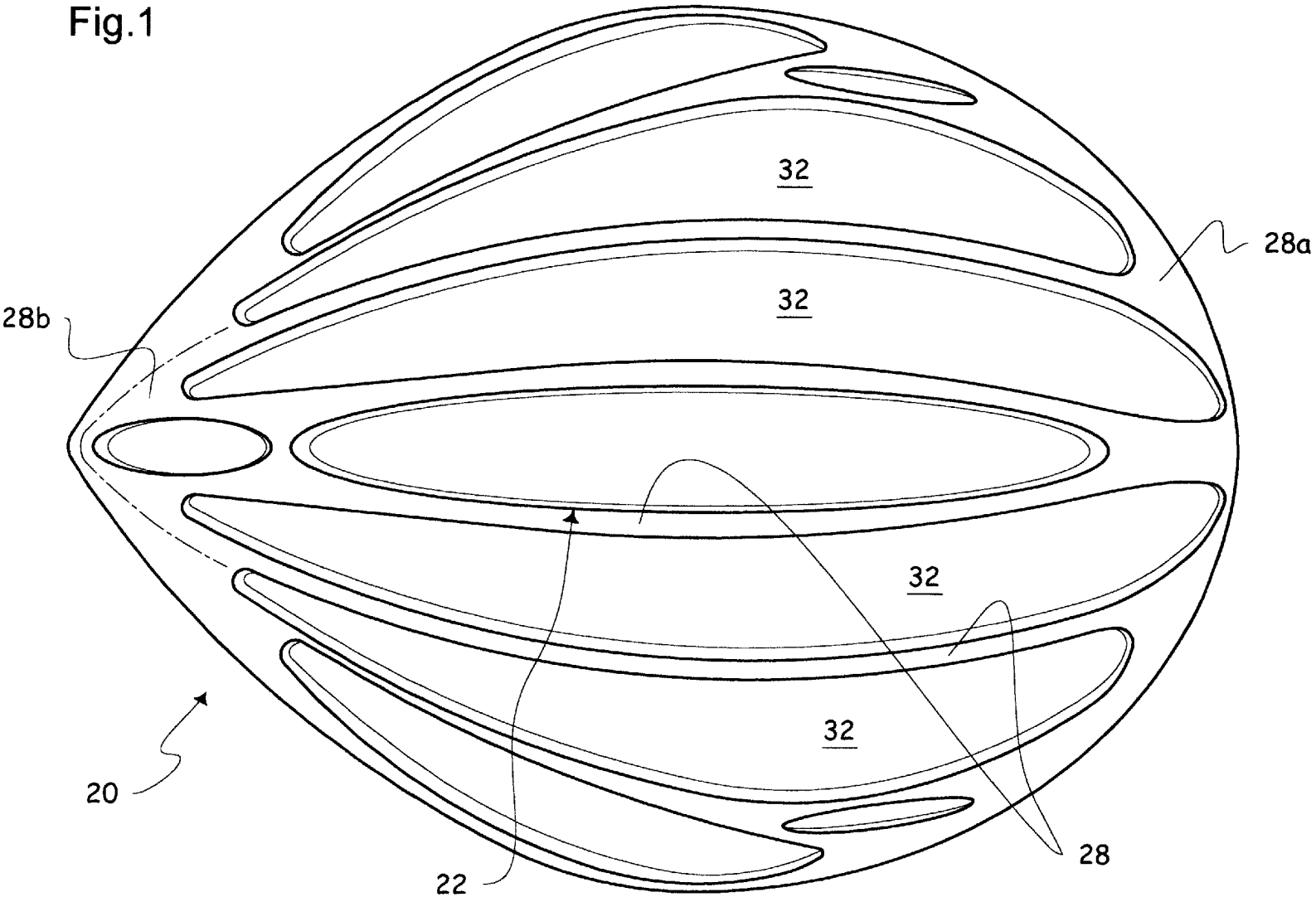
FIG. 1 is a top plan view of a cyclist helmet according to a first embodiment of the invention.
Figure 1A:
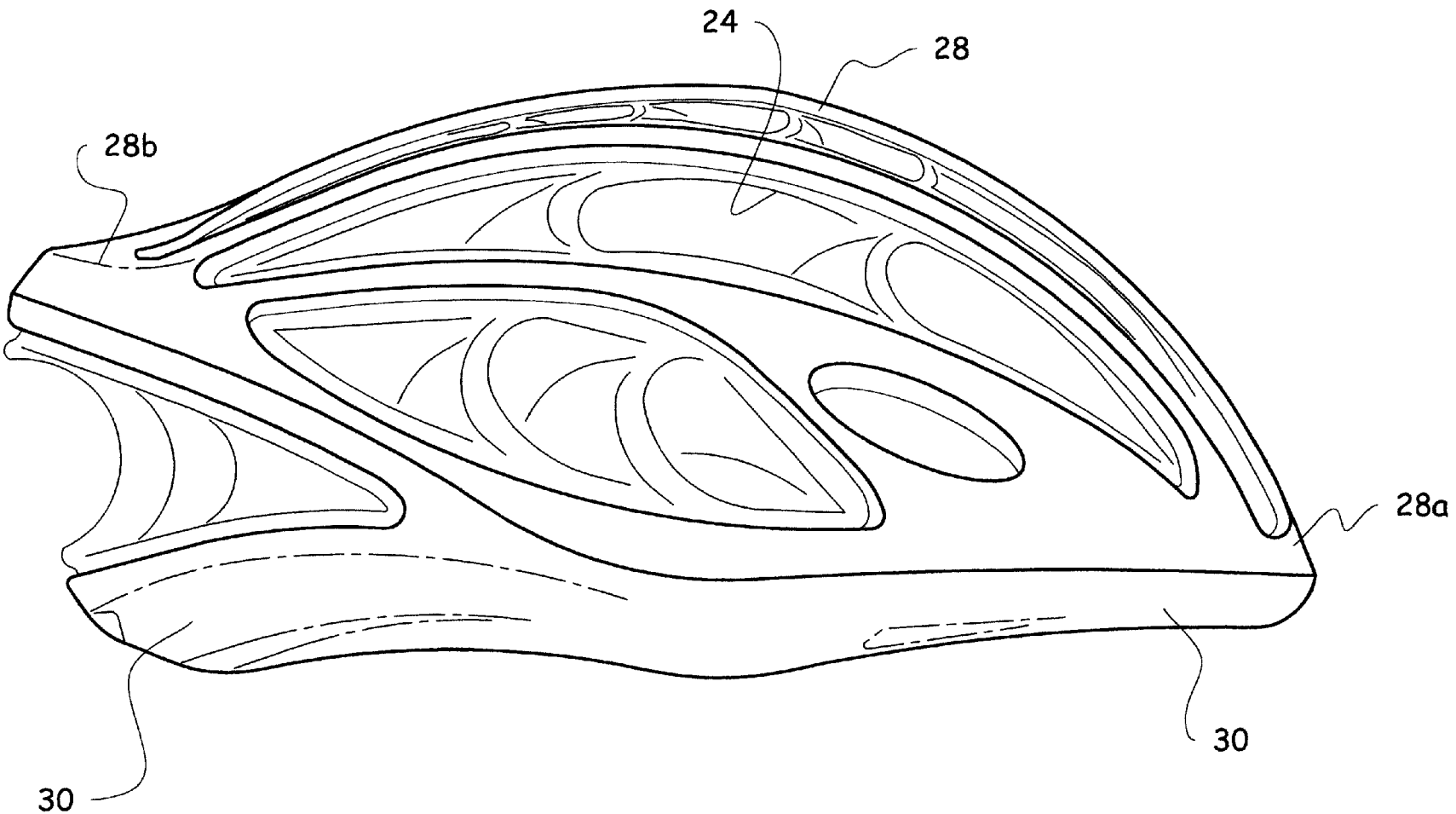
FIG. 1A is a side elevational view of the helmet of FIG. 1.
Figure 1B:
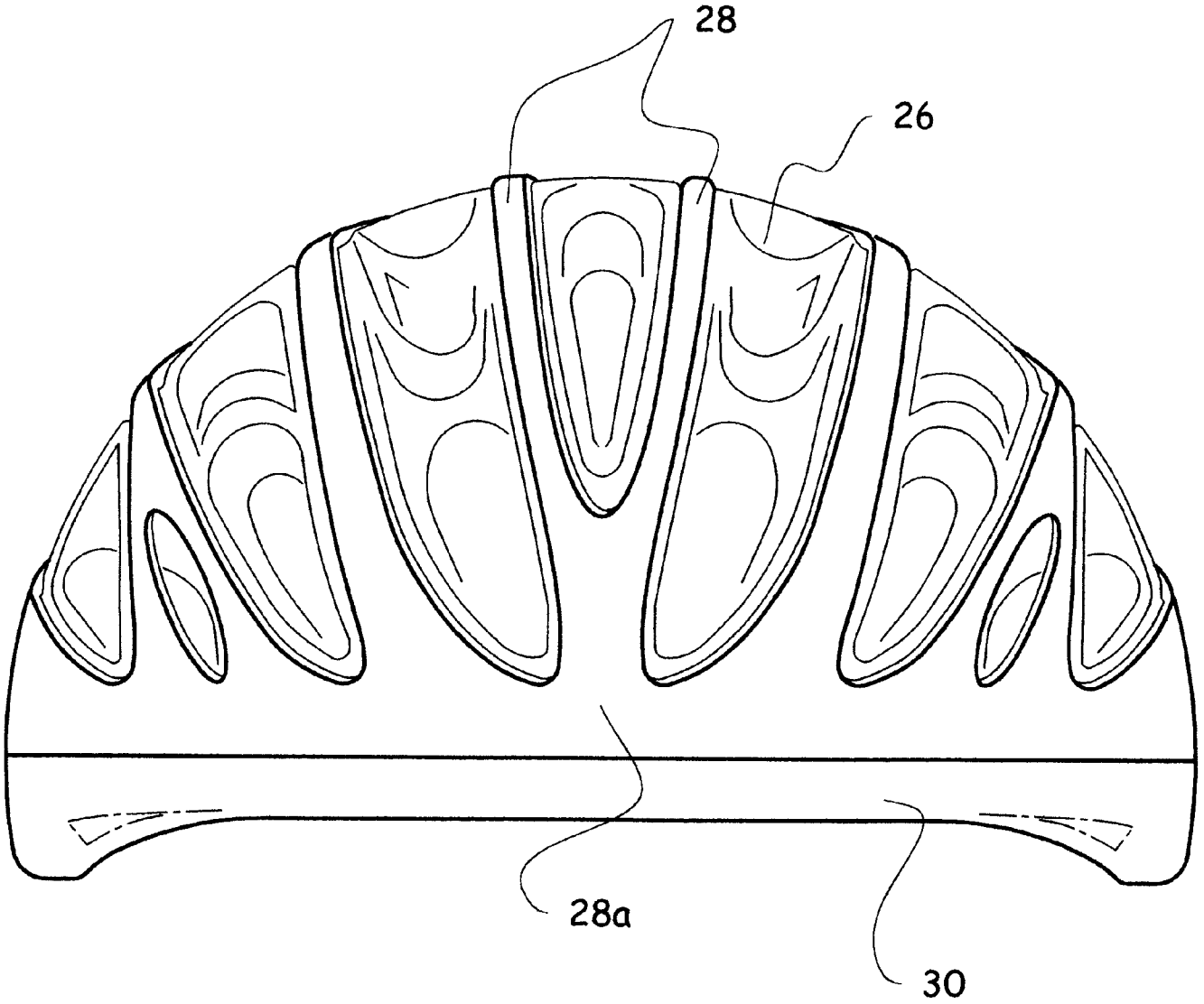
FIG. 1B is a front elevational view of the helmet of FIG. 1.

The helmet shown as 20 in FIGS. 1, 1A and 1B, defines a main external shell 22, a main internal shell 24, and a shock absorbing foam insert 26 located in between the shells 22 and 24. The helmet consists of a generally open concave structure, with the main external shell 22 having a number of fore and aft extending structural arms 28. Elongated fore and aft arms 28 are generally straight in the fore and aft direction in this first embodiment of helmet, although arms 28 will be concave to conform to the shape of the cyclist head. Arms 28 are transversely spaced from one another, and merge with an annular bottom edge rim 30 at both their fore and aft ends 28*a,* 28*b.* Air ventilation passages 32 are formed in between each pair of successive U arms 28, extending through corresponding openings in the shock absorbing insert 26 and through the open mouth formed by the annular internal shell 24.

Each elongated structural arm 28 forms a narrow U-shape in cross-section, for reinforcing the helmet structure. The shock absorbing foam of the insert 26 engages with the grooves 34 formed by these cross-sectionally U-shape structural arms 28. In this first embodiment of cyclist helmet, the grooves 34 are radially inturned. However, they may also the radially outturned in an alternate embodiment, 28", as illustrated in FIG. 9.

As best shown in figures 10*a*–10*c* and 11*a*–11*c* of the drawings, these inturned U-arms 28 from the first embodiment of the invention extend radially outwardly from the external surface of the shock absorbing insert. These U-arms 28 may be rounded, as in FIGS. 11A, 11B, 11C, or may form square U-arms 28', as in FIGS. 10A, 10B, 10C. The radius of curvature of the structural arms 28, 28' is greater than that of the shock absorbing insert 26. Preferably as illustrated, the insert material at the external surface 26*a* of the shock absorbing insert 26, which comes in register with the groove 34 formed by the structural arms 28, will project radially outwardly thereinto, so as to form a radially outturned bulge 26*b* inside the corresponding structural arms 28.

Accordingly, since the radius of curvature of the structural U-arms 28, 28', is greater than of the main external exposed surface 26*a* of the shock absorbing insert 26, upon the cyclist head accidentally impacting on the ground, a first blow will be sustained by the structural U-arms 28, 28', and associated insert bulge 26*b*, wherein some kinetic energy will be dissipated as the structural U-arms sink only partially into the underlying shock absorbing insert. Upon a second impact of the cyclist head against ground or other obstacle, the structural U-arms will further sink into the insert. Accordingly, it has been discovered that unexpectedly, progressive stepwise kinetic impact energy absorption from successive impact blows sustained by the helmet is achieved, without compromising the head-shielding properties of the helmet. This means that the present helmet should remain integral even after a number of impacts, and that the head protecting features of this helmet will remain effective for a longer duration and after more abusive impacting treatment than with prior art cyclist helmets.

Figure 9:
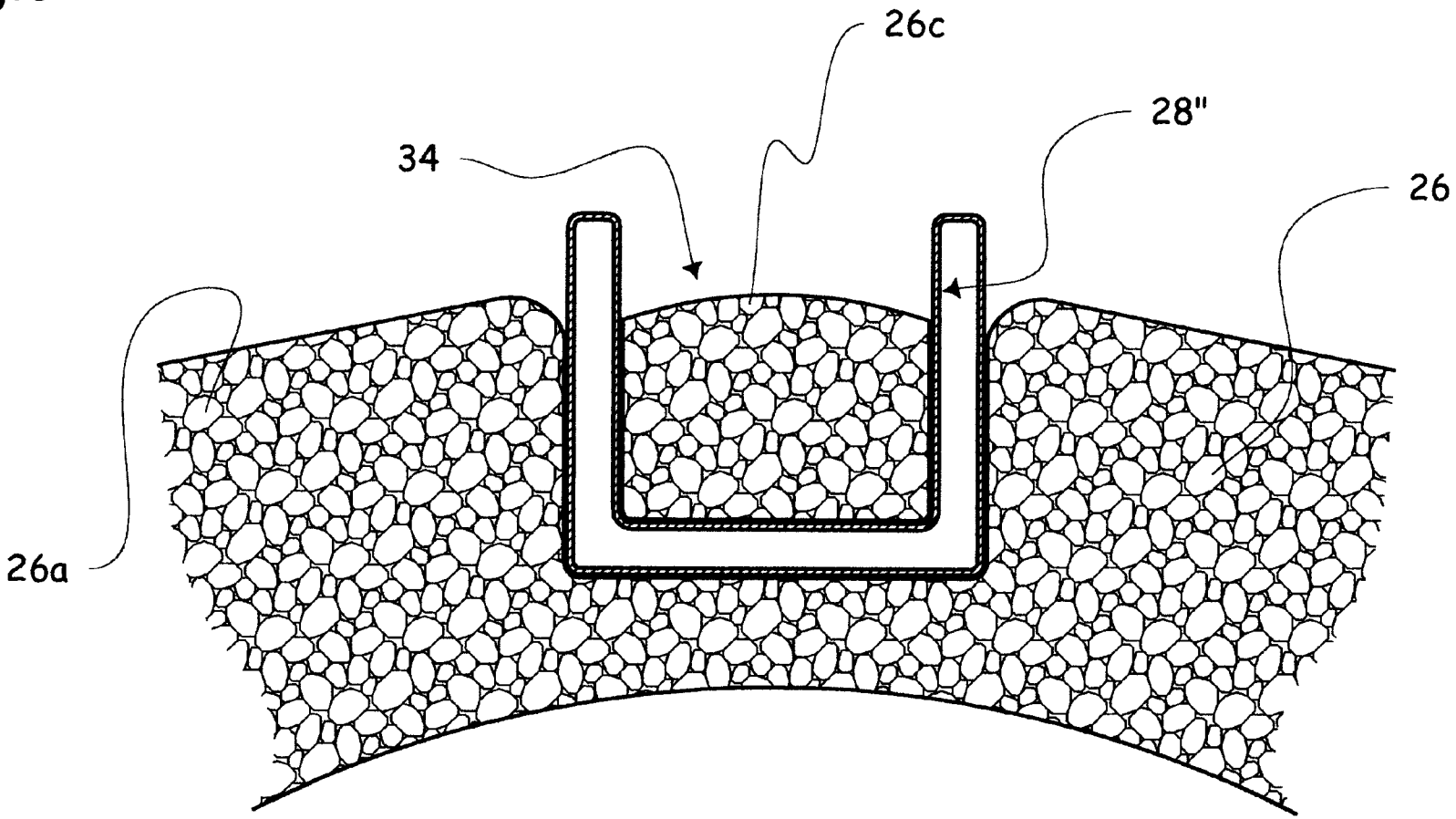
FIG. 9 is an enlarged sectional view of the cyclist helmet, showing an arcuate cross-sectionally square U-shape arm embedded into the shock absorbing foam layer of the helmet according to a first open outturned orientation.
Figure 10C:
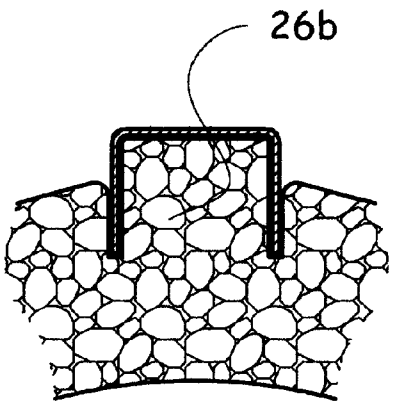
FIGS. 10*a,* 10*b,* and 10*c,* are views similar to FIG. 9, but at a smaller scale and showing arcuate cross-sectionally square U-shape arms embedded into the shock absorbing foam layer of the helmet according to a second closed inturned orientation.
Figure 10B:
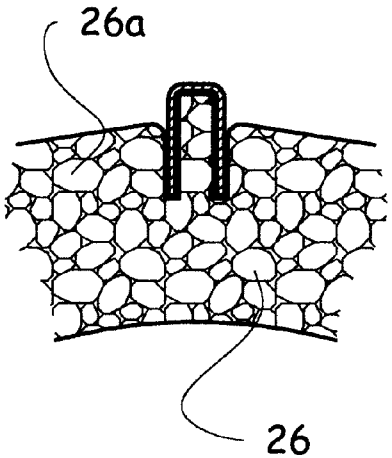
Figure 10A:
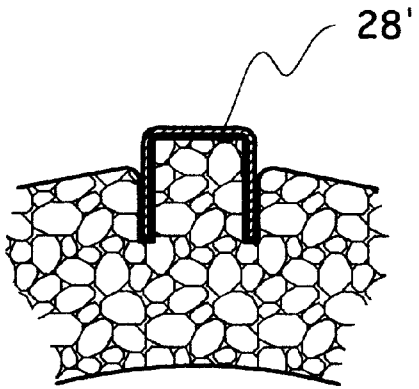
Figure 11C:
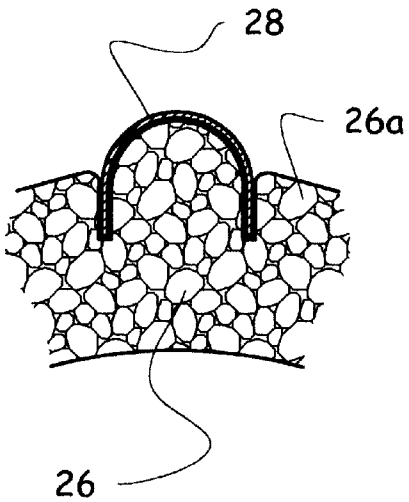
FIGS. 11*a,* 11*b,* and 11*c,* are views similar to FIGS. 10*a,* 10*b,* 10*c,* but showing alternate arcuate cross-sectionally rounded U-shape arms embedded into the shock absorbing foam layer.
Figure 11B:
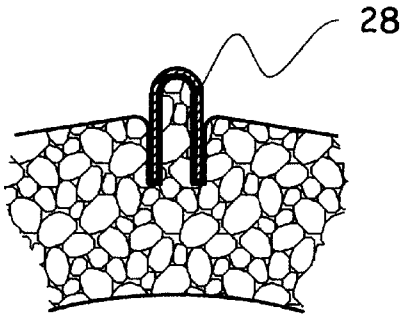
Figure 11A:
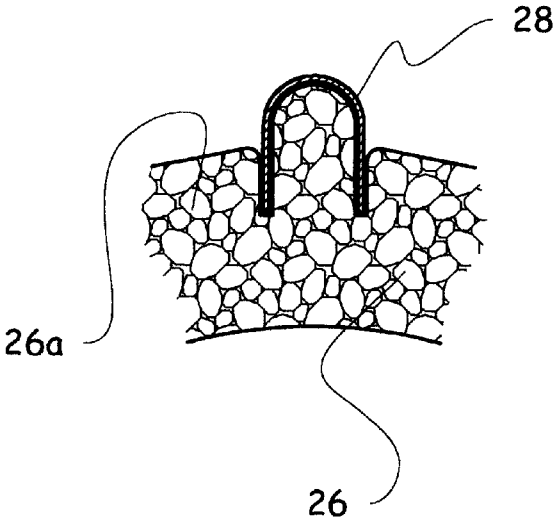

As shown in FIG. 9, the structural U-arms 28" may be radially outturned, i.e. with the groove thereof 34 opening radially outwardly. In this alternate disposition of the U-arms 28", some foam material of the insert 26 is embedded into the groove 34, but the radially outward surface 26*c* of the insert foam material inside the groove 34 of the U-arm 28" does not project radially outwardly beyond the radially outwardly exposed surface 26*a* of the main shock absorbing insert 26. However, the free end portions of the two legs 29*a*, 29*b* of U-arm 28" project radially outwardly from this radially outward exposed surface 26*a* of the shock absorbing foam insert 26, as illustrated.

Figure 2:
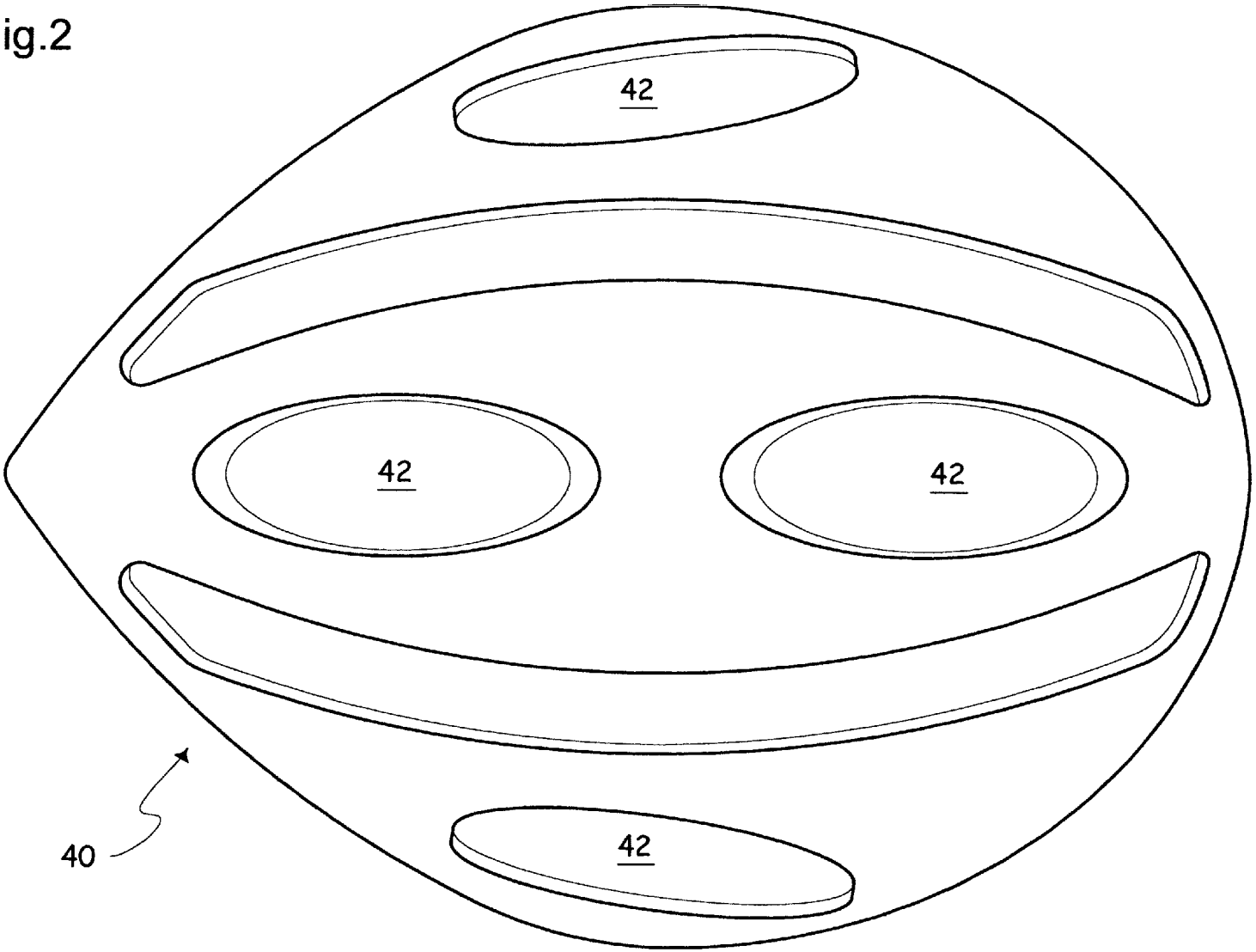
FIG. 2 is a top plan view of a second embodiment of cyclist helmet according to this invention.

In the alternate embodiment of helmet 40 of FIG. 2, circular or ellipsoid air ventilation apertures 42 are added into the shock absorbing insert, for enhanced air circulation.

Figure 3:
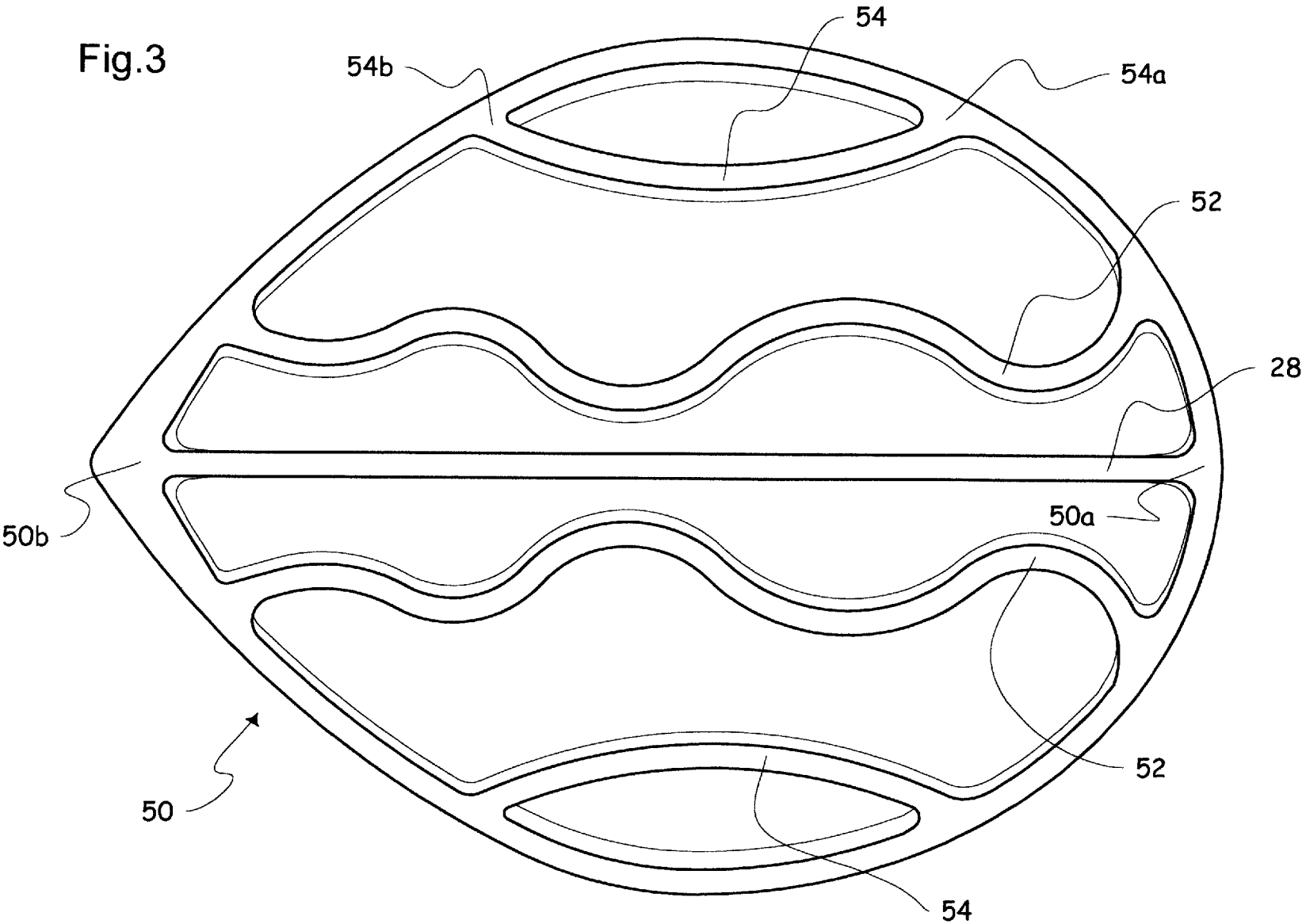
FIG. 3 is a top plan view of a third embodiment of cyclist helmet according to this invention.

In the alternate embodiment of helmet 50 of FIG. 3, some of the structural U-arms 52 extend along an irregular, wavy, or sinusoidal pattern, as shown, another intermediate arm 28 extends straight, while still other lateral side structural U-arms 54 extend in an arcuate fashion. The fore and aft ends 54A, 54B, of the structural U-arms 52 may for example extend short of the fore and aft ends 50A, 50B, of the helmet 50. The other features of the helmet components remain the same.

Figure 4:
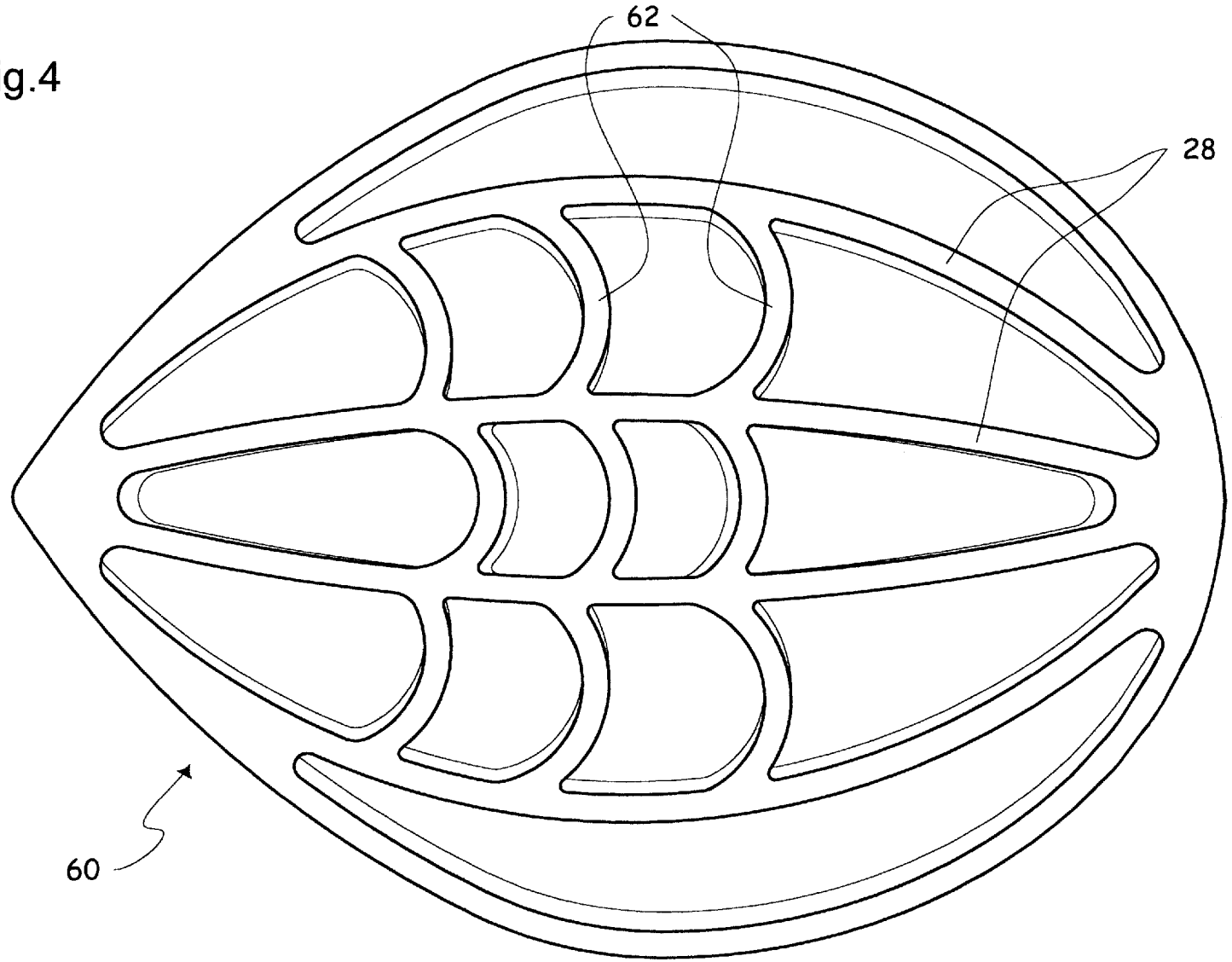
FIG. 4 is a top plan view of a fourth embodiment of cyclist helmet according to the present invention.

In the alternate embodiment of helmet 60 shown in FIG. 4, helmet 60 is very similar to the one shown in FIG. 1, except that some of the successive pairs of fore and aft structural U-arms 28 are joined by transversely extending, accurate, structural U-arms extensions 62. These transverse extensions 62, which enable two successive fore and aft U-arms 28 to transversely interconnected at selected intervals, may structurally reinforce the helmet, although the air circulation may be less compared to the first embodiment of helmet in FIG. 1.

Figure 5:
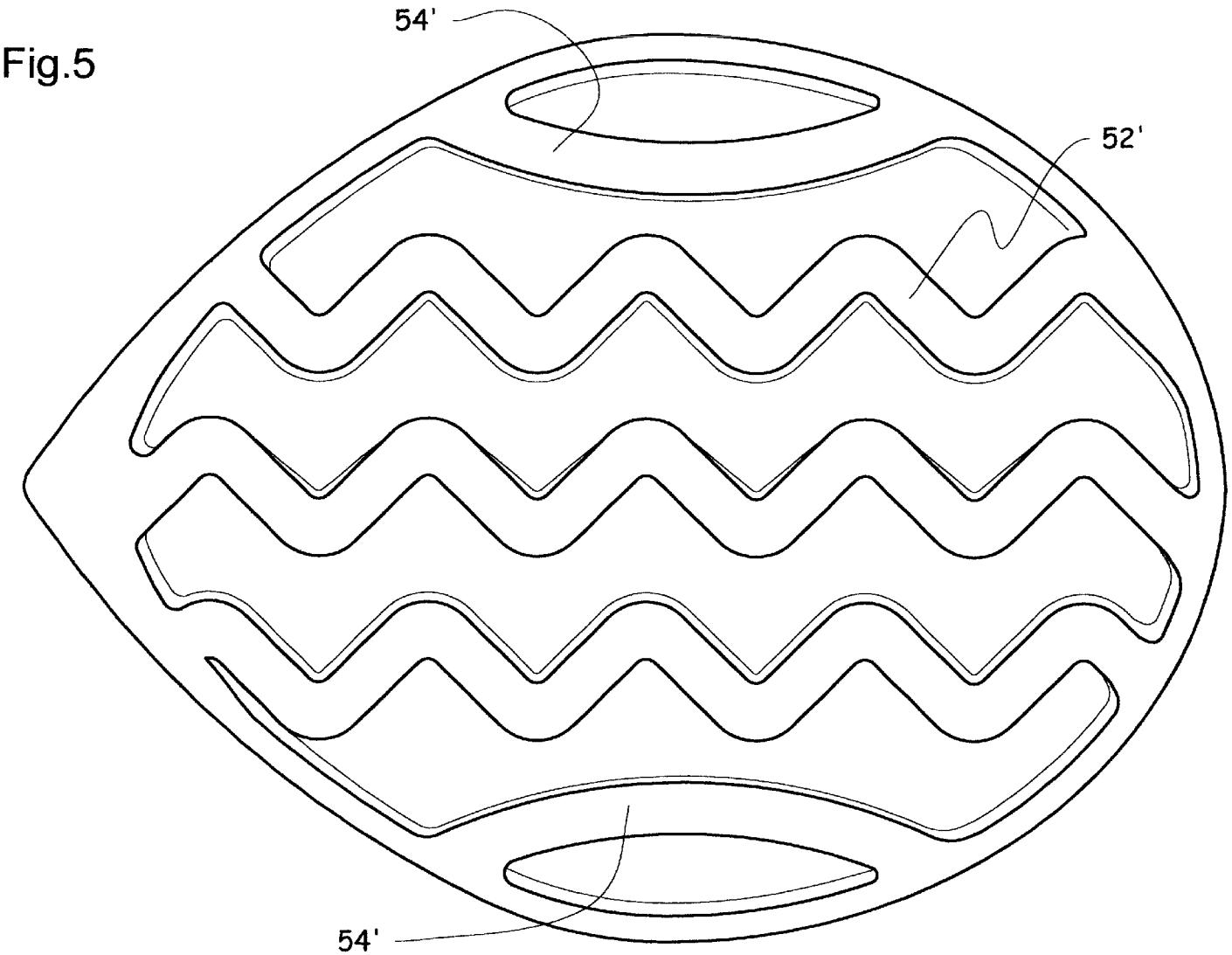
FIG. 5 is a top plan view of a fifth embodiment of cyclist helmet according to this invention.

The alternate embodiment of helmet 70 shown in FIG. 5, is very similar to that of FIG. 3, except that the width of the structural U-arms 52', 54', is larger, and that there is no central U-arm 28.

Figure 6:
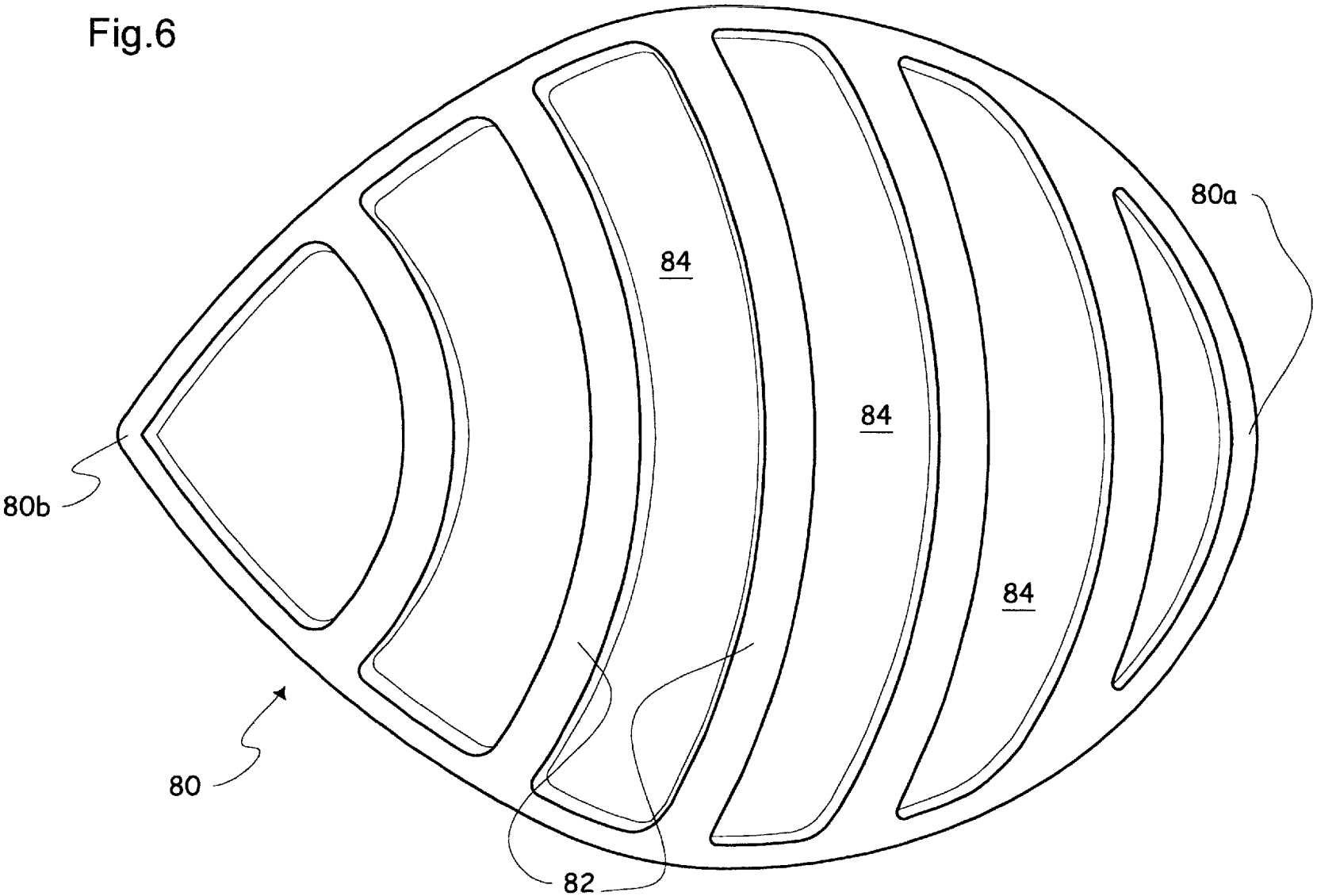
FIG. 6 is a top plan view of a sixth embodiment of cyclist helmet of the invention.

In the alternate embodiment of helmet 80 of FIG. 6, the structural U-arms 82 extend transversely rather than in a fore and aft direction. U-arms 82 are also arcuate, and progressively more so as we move from the fore end 80A to the aft end 80B of the helmet 80. Wide interspacing gaps 84 remain in between each successive pair of U-arms 82, for proper air circulation around the cyclist head.

Figure 7:
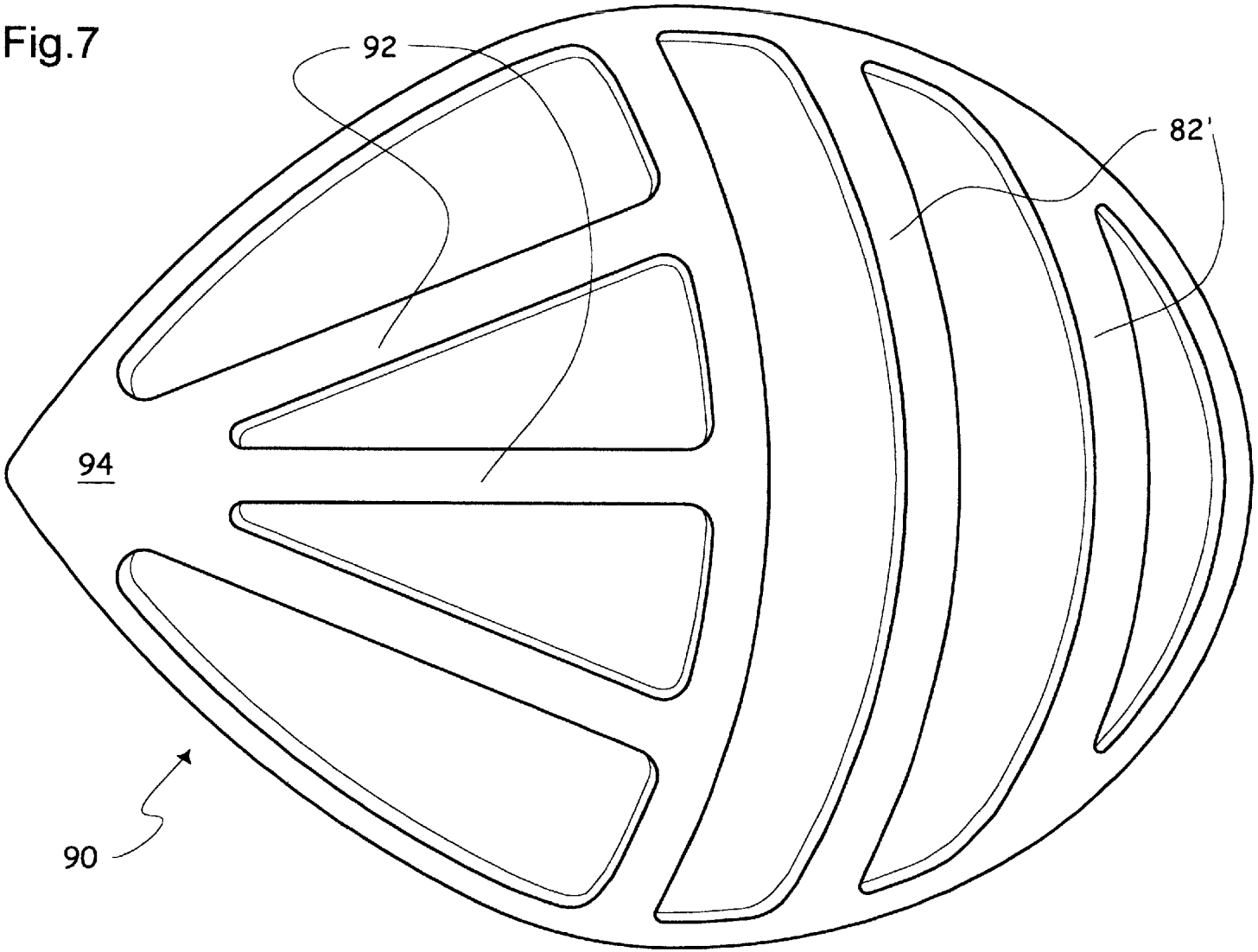
FIG. 7 is a top plan view of a seventh embodiment of cyclist helmet of the invention.

The alternate embodiment of helmet 90 of FIG. 7 of the drawings, is quite similar to the helmet of FIG. 6, with transverse U-arms 82' at the fore section thereof. However, the difference is in the aft section of the helmet 90, being made up of straight structural U-arms 92 projecting from the aftmost transverse U-arm 82' and converging toward a single aft point 94 of the helmet 90.

Figure 8:
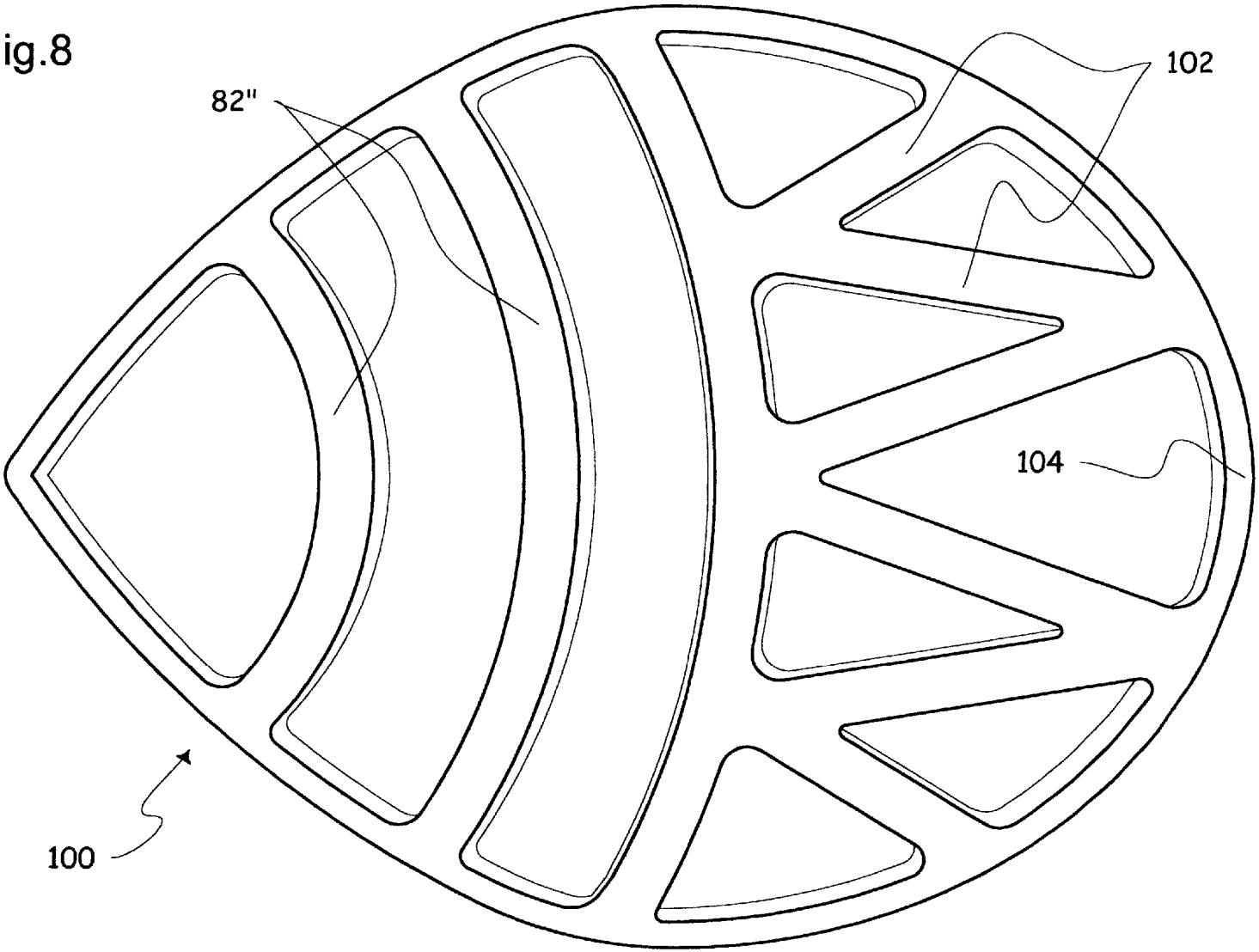
FIG. 8 is a top plan view of an eighth embodiment of cyclist helmet of the invention.

The alternate embodiment of helmet 100 of FIG. 8, is again quite similar to the helmet of FIG. 6, with transverse arcuate U-arms 82" at the aft section thereof. However, the difference is in the fore section of the helmet 100, being made up of zig-zaging structural U-arms 102 projecting from the foremost transverse U-arm 82", and merging with several points at the fore rim end 104 of the helmet 100.

The fore and aft extending structural U-arms 28 preferably constitute composite beams made from molded polycarbonate plastic material, preferably reinforced with polystyrene.

The transverse spacing 32 between a pair of successive fore and aft extending structural U-arms may be for example about 38 mm. Each of the three legs of the cross-sectionally U-shape structural arm may be of a length ranging between for example 3 and 38 mm, but preferably being of a size of about 7×7×7 mm. The shock absorbing insert is made for example from ABS plastic material.

Preferably, the U-arms and the shock absorbing inserts are interconnected by the inmold process technology.

It is understood that other variations in the layout of the cross-sectionally U-shape structural arms, will remain within the scope of the present invention.

We claim:

1. A generally open concave bicycle helmet comprising a hard external shell, a shock absorbing insert located radially inwardly of said external shell; said external shell defining a number of fore and aft extending structural arms, each of said structural arms having a fore end and an aft end, said structural arms transversely spaced from one another in transversely successive pairs by transverse inter-spacing gaps, said structural arms merging with an annular edge rim at both said fore end and aft end thereof, said insert having radial passageways in register with said inter-spacing gaps, said inter-spacing gaps and said radial passageways forming air ventilation channels; each of said structural arms being arcuate in cross-section, said arcuate structural arms each forming two side walls circumscribing therebetween a corresponding groove, said insert defining an exposed surface, said structural arm side walls being embedded into selected portions of said insert exposed surface; wherein said structural arms protect radially outwardly from said insert exposed surfaces.

2. A bicycle helmet as in claim 1, wherein said structural arms consist of U-shape arms, said arms side wall being inturned against said insert.

3. A bicycle helmet as in claim 1, wherein said insert exposed surface includes a number of projecting ridges, said insert ridges engaging into each said groove of corresponding said structural arms, said insert ridges extending radially outwardly beyond said insert exposed surface.

4. A bicycle helmet as in claim 2, wherein said insert exposed surface includes a number of projecting ridges, said insert ridges engaging into each said groove of corresponding said structural arms, said insert ridges extending radially outwardly beyond said insert exposed surface.

5. A bicycle helmet as in claim 1, wherein the depth of said arms groove ranges between 3 and 38 mm.

6. A bicycle helmet as in claim 1, wherein the total width of each of said structural arms ranges between 3 and 38 mm.

7. A bicycle helmet as in claim 1 wherein the depth of said arms groove and the width of each of said structural arms each ranges between 3 and 38 mm.

8. A bicycle helmet as in claim 7, wherein the depth of said arms groove and the width of each of said structural arms is of a size of about 7 mm.

9. A bicycle helmet as in claim 1, wherein the material forming said structural U-arms is molded polycarbonate plastic material.

10. A bicycle helmet as in claim 1, wherein said structural U-arms extend in a generally straight fashion in the fore and aft direction.

11. A bicycle helmet as in claim 1, wherein said structural U-arms extend in a sinusoidal fashion in the fore and aft direction.

12. A bicycle helmet as in claim 1, wherein each of said structural U-arms converge from said aft end to said fore end thereof.

13. A bicycle helmet as in claim 1, wherein each one of said inter-spacing gaps ranges between 3 and 38 mm.

14. A bicycle helmet comprising a generally open concave shock absorbing insert, said insert defining a top exposed surface and an internal face in communication with one another via air circulation passageways extending radially through said insert, a number of rigid reinforcing cross-sectionally U-shape hoops extending across corresponding strip portions of said insert exposed surface, each of said U-shape hoops defining two opposite side legs and a groove between said side legs, said hoops side legs being embedded radially inwardly into corresponding said insert strip portions; wherein said hoops project radially outwardly from said insert exposed surface.

15. A bicycle helmet as in claim 14, further including ridges, radially outwardly projecting from said insert exposed surface integral thereto, said ridges engaging substantially fully into each said groove of said U-shape hoops and also projecting radially outwardly beyond said insert exposed surface.

16. A bicycle helmet as in claim 15, wherein the depth and total width of said ridges each ranges between 3 and 38 mm.

17. A bicycle helmet as in claim 16, wherein the depth and total width of said ridges each is about 7 mm.

18. A bicycle helmet as in claim 17, wherein said hoops extend in a direction selected from the following: straight, sinusoidal and arcuate patterns.

19. A bicycle helmet comprising a generally open concave shock absorbing insert, said insert defining a top exposed surface and an internal face in communication with one another via air circulation passageways extending radially through said insert, a number rigid reinforcing cross-sectionally U-shape hoops extending across corresponding fore and aft extending strip portions of said insert exposed surface, each of said U-shape hoops defining two opposite side legs and a groove between said side legs, said hoops side legs being embedded into corresponding said insert strip portions; wherein said hoops project radially outwardly from said insert exposed surface.

20. A bicycle helmet as defined in claim 19, wherein the depth and total width of said hoops each ranges between 3 and 38 mm.

* * * * *